US011136532B2

(12) United States Patent
Delplancke et al.

(10) Patent No.: US 11,136,532 B2
(45) **Date of Patent: *Oct. 5, 2021**

(54) LIQUID HAND DISHWASHING DETERGENT COMPOSITION

(71) Applicant: The Procter & Gamble Company, Cincinnati, OH (US)

(72) Inventors: Patrick Firmin August Delplancke, Steenhuize-Wijnhuize (BE); Robby Renilde Francois Keuleers, Lippelo (BE); Nuray Yaldizkaya, Ghent (BE)

(73) Assignee: The Procter & Gamble Company, Cincinnati, OH (US)

( * ) Notice: Subject to any disclaimer, the term of this patent is extended or adjusted under 35 U.S.C. 154(b) by 3 days.

This patent is subject to a terminal disclaimer.

(21) Appl. No.: 16/197,532

(22) Filed: Nov. 21, 2018

(65) Prior Publication Data

US 2019/0161704 A1 May 30, 2019

(30) Foreign Application Priority Data

Nov. 27, 2017 (EP) ..... 17203786
Sep. 24, 2018 (EP) ..... 18196142

(51) Int. Cl.

| | |
|---|---|
| ***C11D 1/29*** | (2006.01) |
| ***C11D 1/75*** | (2006.01) |
| ***C11D 3/30*** | (2006.01) |
| ***C11D 1/722*** | (2006.01) |
| ***C11D 3/37*** | (2006.01) |
| ***C11D 11/00*** | (2006.01) |
| ***C11D 1/94*** | (2006.01) |
| ***C11D 1/83*** | (2006.01) |
| ***C11D 3/00*** | (2006.01) |
| ***C11D 1/72*** | (2006.01) |
| *C11D 1/14* | (2006.01) |
| *C11D 1/90* | (2006.01) |

(52) U.S. Cl.

CPC ..... *C11D 3/3707* (2013.01); *C11D 1/72* (2013.01); *C11D 1/722* (2013.01); *C11D 1/83* (2013.01); *C11D 1/94* (2013.01); *C11D 3/0094* (2013.01); *C11D 3/30* (2013.01); *C11D 3/3723* (2013.01); *C11D 11/0023* (2013.01); *C11D 1/146* (2013.01); *C11D 1/29* (2013.01); *C11D 1/75* (2013.01); *C11D 1/90* (2013.01)

(58) Field of Classification Search

CPC .. C11D 1/29; C11D 1/72; C11D 1/722; C11D 1/75; C11D 3/30; C11D 3/3723

USPC ..... 510/237, 424, 427, 475, 499, 503, 505, 510/506

See application file for complete search history.

(56) References Cited

U.S. PATENT DOCUMENTS

| | | | | |
|---|---|---|---|---|
| 4,904,359 | A | 2/1990 | Pancheri | |
| 6,274,539 | B1 | 8/2001 | Kacher | |
| 6,774,099 | B1 * | 8/2004 | Scheibel | C11D 1/83 510/357 |
| 8,168,005 | B2 | 5/2012 | Borne | |
| 9,637,464 | B2 * | 5/2017 | Morita | C08G 65/331 |
| 9,969,956 | B2 | 5/2018 | Braeckman | |
| 9,969,960 | B2 | 5/2018 | Perez-garcia | |
| 10,611,985 | B2 * | 4/2020 | Delplancke | C11D 1/83 |
| 10,689,598 | B2 * | 6/2020 | Delplancke | C11D 17/0008 |
| 10,844,336 | B2 * | 11/2020 | Brouwers | C11D 3/3707 |
| 10,934,510 | B2 | 3/2021 | Brouwers et al. | |
| 2003/0064900 | A1 | 4/2003 | Borgonjon | |
| 2003/0096725 | A1 * | 5/2003 | Tsibouklis | C11D 3/3707 510/421 |
| 2003/0148913 | A1 * | 8/2003 | Klinkhammer | C11D 1/008 510/421 |
| 2005/0272619 | A1 | 12/2005 | Borgonjon | |
| 2006/0105936 | A1 | 5/2006 | Shi et al. | |
| 2007/0275868 | A1 | 11/2007 | Cooremans | |
| 2008/0300158 | A1 | 12/2008 | Schutz | |
| 2010/0009886 | A1 * | 1/2010 | Smith | C11D 1/83 510/182 |
| 2010/0204078 | A1 * | 8/2010 | Smith | C11D 3/32 510/238 |
| 2012/0021963 | A1 * | 1/2012 | Kneipp | C11D 3/364 510/259 |
| 2012/0046213 | A1 | 2/2012 | Braeckman et al. | |
| 2012/0317736 | A1 | 12/2012 | Gonzales et al. | |
| 2015/0275143 | A1 * | 10/2015 | Hulskotter | C11D 1/008 510/320 |
| 2015/0275144 | A1 * | 10/2015 | Hulskotter | C11D 3/38618 510/360 |
| 2015/0315522 | A1 * | 11/2015 | Hulskotter | C11D 3/185 510/235 |
| 2016/0201014 | A1 | 7/2016 | Perez-garcia | |

(Continued)

FOREIGN PATENT DOCUMENTS

| | | | |
|---|---|---|---|
| EP | 0222557 | A3 | 9/1988 |
| JP | 2006083069 | A | 3/2006 |
| WO | WO9856884 | A1 | 12/1998 |

OTHER PUBLICATIONS

BASF: Pluronic PE 3100 Pluronic PE 8100 Pluronic PE 4300 Pluronic PE 9200 Pluronic PE 6100 Pluronic PE 9400 Pluronic PE 6200 Pluronic PE 10100 Pluronic PE 6400 Pluronic PE 10500 Pluronic PE 6800 Low-foaming block copolymers for a widevariety of applications Feb. 1, 1996 (Feb. 1, 1996). XP055478494. Retrieved from the Internet: www.timing-ouhan.com[retrieved on May 25, 2018] the whole document.

(Continued)

*Primary Examiner* — Gregory R Delcotto
(74) *Attorney, Agent, or Firm* — Melissa Krasovec

(57) ABSTRACT

The present invention relates to a hand dishwashing detergent composition including a surfactant system and at least one triblock co-polymer of Formula (I): (EO)x-(PO)y-(EO)x wherein each x is independently on average between about 1 and about 40, and y is on average between about 1 and about 15.

12 Claims, No Drawings

(56) References Cited

U.S. PATENT DOCUMENTS

| | | | | |
|---|---|---|---|---|
| 2017/0009189 | A1* | 1/2017 | Rees | C11D 3/2068 |
| 2017/0121636 | A1* | 5/2017 | Delplancke | C11D 17/0008 |
| 2017/0121637 | A1* | 5/2017 | Delplancke | C11D 1/75 |
| 2018/0216037 | A1* | 8/2018 | Hamersky | C11D 1/29 |
| 2019/0093050 | A1 | 3/2019 | Man et al. | |
| 2019/0161703 | A1 | 5/2019 | Delplancke | |
| 2019/0161705 | A1 | 5/2019 | Delplancke | |
| 2020/0377826 | A1 | 12/2020 | Braeckman et al. | |
| 2021/0108158 | A1 | 4/2021 | Braeckman et al. | |

OTHER PUBLICATIONS

CM4915F EP Search Report for appl. No. 17203786.3-1105, dated Jun. 11, 2018, 7 pages.
CM4915FM EP Search Report for appl. No. 18196142.6-1105, dated Apr. 5, 2019, 5 pages.
All Office Actions, U.S. Appl. No. 16/197,525.
All Office Actions, U.S. Appl. No. 16/197,539.

* cited by examiner

LIQUID HAND DISHWASHING DETERGENT COMPOSITION

FIELD OF THE INVENTION

The present invention relates to a liquid hand dishwashing detergent composition comprising a surfactant system and at least one triblock co-polymer of Formula (I): (EO)x-(PO)y-(EO)x, wherein each x is independently on average between 1 and 40, preferably between 3 and 35, more preferably between 3 and 30, even more preferably between 3 and 20, most preferably between 3 and 10, and y is on average between 1 and 15, preferably between 5 and 15. The composition provides good sudsing profile, in particular enhanced suds stabilization benefit in the presence of greasy soils and/or enhanced suds consistency through dilution throughout the washing process.

BACKGROUND OF THE INVENTION

Traditionally, manual dishwashing is performed in a sink full of water with the detergent composition diluted in it. Nowadays, some users prefer to wash one or a small number of items under running water using a cleaning implement, preferably a sponge. The detergent composition is dosed onto the dishware or alternatively the cleaning implement before or after the implement is wetted, a soiled item is then wiped, and subsequently rinsed under running water. With both methods, the user usually relies on the sudsing profile as an indicator of the composition's cleaning ability. Accordingly, the user requires that the detergent composition have a good sudsing profile.

To qualify a dishwashing detergent as having a good sudsing profile, the generated foam must produce high suds volume and/or longevity (i.e., mileage) of the suds (i.e., stable suds), preferably with sustained suds aesthetics throughout dilution during the wash process (i.e., suds consistency), to indicate to the user that sufficient active ingredients (e.g., surfactants) are present to perform the desired cleaning. Previous attempts to improve sudsing profile have not focused on the use of ethyleneoxide (EO)-propyleneoxide (PO)-ethyleneoxide (EO) triblock co-polymers according to the invention to provide enhanced suds generation and/or suds stabilization in the presence of greasy soils. On the contrary, these EO-PO-EO triblock copolymer technologies have been positioned as low foaming surfactants or even de-foaming surfactants according to the technical data sheets from by their manufacturers, (e.g., Pluronic® PE6400 available from BASF and Tergitol™ L-64 available from the Dow Chemical Company). In fact, EO-PO-EO triblock co-polymers are advertised as suitable surfactants for automatic dishwashing applications where foam is to be minimized or prevented in order to avoid the rotating arms from blocking.

Thus, the need remains for a detergent composition having a good sudsing profile, in particular enhanced suds volume and/or enhanced suds stabilization benefits in the presence of greasy soils, particularly through-out the entire manual dishwashing operation. The need also exists for a detergent composition, particularly a liquid hand dishwashing detergent composition, that sustains suds aesthetics through dilution throughout the washing process, and provides good product dissolution and cleaning, particularly good cleaning of greasy soils. The Applicant has discovered that some or all of the above-mentioned needs can be at least partially fulfilled through cleaning compositions as described herein below.

U.S. Pat. No. 4,904,359 A relates to high sudsing liquid detergent compositions contain anionic surfactant and polymeric surfactant which contains ether linkages, the anionic surfactant forming stable complexes with the polymeric surfactant for improved grease handling. US 2008/300158 A relates to a method of cleaning dishware with a liquid detergent composition having an amphiphilic graft polymer, to provide improved grease cleaning and sudsing. US 2003/064900 A relates to a composition for use as a foaming hand dishwashing composition comprising a hydrophobic polymer having molecular weight of at least 500 and comprising butylene oxide moieties with the proviso that the composition does not comprise greater than 5% by weight of the composition of builder.

SUMMARY OF THE INVENTION

The present invention meets one or more of these needs based on the surprising discovery that by formulating a detergent composition having a surfactant system and at least one triblock co-polymer of Formula (I): (EO)x-(PO)y-(EO)x, wherein each x is independently on average between 1 and 40, preferably between 3 and 35, more preferably between 3 and 30, even more preferably between 3 and 20, most preferably between 3 and 10, and y is on average between 1 and 15, preferably between 5 and 15, such a composition exhibits good sudsing profile, particularly desirable suds volume and sustained suds stabilization in the presence of greasy soils.

In one aspect, the present invention is directed to a liquid hand dishwashing detergent composition comprising from 1% to 60%, preferably from 5% to 50%, more preferably from 8% to 45%, most preferably from 15% to 40%, by weight of the total composition of a surfactant system, and from 0.1% to 10%, preferably from 0.5% to 7.5%, more preferably from 1% to 5%, by weight of the total composition of at least one ethyleneoxide (EO)-propyleneoxide (PO)-ethyleneoxide (EO) triblock co-polymer of Formula (I):

$$(EO)x\text{-}(PO)y\text{-}(EO)x \quad (I)$$

wherein: each x represents the number of EO units and each x is independently on average between 1 and 40, preferably between 3 and 35, more preferably between 3 and 30, even more preferably between 3 and 20, most preferably between 3 and 10; and y is on average between 1 and 15, preferably between 5 and 15.

The surfactant system comprises an anionic surfactant, preferably the anionic surfactant is selected from the group consisting of alkyl sulfate, alkyl alkoxy sulfate preferably alkyl ethoxy sulfate, and mixtures thereof, and a primary co-surfactant selected from the group consisting of an amphoteric surfactant, a zwitterionic surfactant and mixtures thereof, preferably the amphoteric surfactant is an amine oxide surfactant, the zwitterionic surfactant is a betaine surfactant, and mixtures thereof, more preferably the primary co-surfactant is an amine oxide surfactant.

In another aspect of the invention there is provided a method of manually washing dishware using the composition of the invention. The method comprises the steps of: i) delivering a composition of the invention onto soiled dishware or a cleaning implement, preferably a sponge; ii) cleaning the dishware with the composition in the presence of water; and iii) optionally, rinsing the dishware. Alternatively the method comprises the steps of: delivering a composition of the invention to a volume of water to form a wash solution and immersing the dishware in the solution.

There is also provided the use of the composition of the invention for providing enhanced stabilization of suds in the presence of greasy soils and/or enhanced suds consistency through dilution throughout the washing process.

It is an object of the composition of the present invention to exhibit good sudsing profile, preferably high suds volume and sustained suds aesthetics (i.e., suds consistency) throughout dilution through the washing process.

It is an object of the composition of the present invention to exhibit good sudsing profile, preferably stable suds during a substantial portion of or for the entire manual dishwashing process.

It is an object of the composition to provide good product dissolution and cleaning, preferably good tough food cleaning (e.g., cooked-, baked- and burnt-on soils) and/or good greasy soil cleaning.

These and other features, aspects and advantages of the present invention will become evident to those skilled in the art from the detailed description which follows.

DETAILED DESCRIPTION OF THE INVENTION

Definitions

As used herein, articles such as "a" and "an" when used in a claim, are understood to mean one or more of what is claimed or described.

The term "comprising" as used herein means that steps and ingredients other than those specifically mentioned can be added. This term encompasses the terms "consisting of" and "consisting essentially of." The compositions of the present invention can comprise, consist of, and consist essentially of the essential elements and limitations of the invention described herein, as well as any of the additional or optional ingredients, components, steps, or limitations described herein.

The term "dishware" as used herein includes cookware and tableware made from, by non-limiting examples, ceramic, china, metal, glass, plastic (e.g., polyethylene, polypropylene, polystyrene, etc.) and wood.

The term "grease" or "greasy" as used herein means materials comprising at least in part (i.e., at least 0.5 wt % by weight of the grease) saturated and unsaturated fats and oils, preferably oils and fats derived from animal sources such as beef, pig and/or chicken.

The terms "include", "includes" and "including" are meant to be non-limiting.

The terms "suds" and "foam" are used interchangeably and are meant to indicate discrete bubbles of gas bounded by and suspended in a liquid phase.

The term "sudsing profile" as used herein refers to the properties of a detergent composition relating to suds character during the dishwashing process. The term "sudsing profile" of a detergent composition includes suds volume generated upon dissolving and agitation, typically manual agitation, of the cleaning composition in the aqueous washing solution, and the retention of the suds during the dishwashing process. Preferably, hand dishwashing detergent compositions characterized as having "good sudsing profile" tend to have high suds volume and/or sustained suds volume, particularly during a substantial portion of or for the entire manual dishwashing process. This is important as the consumer uses high suds as an indicator that sufficient cleaning composition has been dosed. Moreover, the consumer also uses the sustained suds volume as an indicator that sufficient active cleaning ingredients (e.g., surfactants) are present, even towards the end of the dishwashing process. The consumer usually renews the washing solution when the sudsing subsides. Thus, a low sudsing detergent composition will tend to be replaced by the consumer more frequently than is necessary because of the low sudsing level.

It is understood that the test methods that are disclosed in the Test Methods Section of the present application must be used to determine the respective values of the parameters of Applicants' inventions as described and claimed herein.

In all embodiments of the present invention, all percentages are by weight of the total composition, as evident by the context, unless specifically stated otherwise. All ratios are weight ratios, unless specifically stated otherwise, and all measurements are made at 25° C., unless otherwise designated.

Detergent Composition

The present invention relates to a liquid hand dishwashing detergent composition having a good sudsing profile, including high suds volume generation and/or enhanced suds stabilization through-out a substantial portion of, or the entire dishwashing process. This signals to the user that there are still sufficient active ingredients present to provide good cleaning performance, as such triggering less re-dosing and overconsumption of the product by the user.

The Applicant has surprisingly found that by selecting a triblock co-polymer of Formula (I), enhanced suds stabilization and/or high suds volume can be achieved. The results are unexpected since previous attempts to improve sudsing profile have not focused on the use of such triblock co-polymers of Formula (I). On the contrary, these EO-PO-EO triblock co-polymer technologies have been positioned as low foaming surfactants or even de-foaming surfactants by their manufacturers (as previously mentioned), and as suitable surfactants for automatic dishwashing applications where foam is to be minimized or prevented in order to avoid the rotating arms from blocking. The applicant surprisingly found that by formulating with this particular subclass of EO-PO-EO triblock co-polymers into a detergent composition leads to enhanced suds stabilization, contrary to alternative EO-PO-EO triblock co-polymers outside the scope of the invention.

Furthermore, the compositions of the present invention provide enhanced suds consistency through dilution throughout the wash process. The composition of the present invention can also provide good grease removal, in particular good uncooked grease removal.

The cleaning composition is a hand dishwashing detergent composition in liquid form. Preferably, the composition contains from 50% to 85%, preferably from 50% to 75%, by weight of the total composition of a liquid carrier in which the other essential and optional components are dissolved, dispersed or suspended. One preferred component of the liquid carrier is water.

Preferably, the pH of the composition is from about 6 to about 14, preferably from about 7 to about 12, or more preferably from about 7.5 to about 10, as measured at 10% dilution in distilled water at 20° C. The pH of the composition can be adjusted using pH modifying ingredients known in the art.

The composition of the present invention can be Newtonian or non-Newtonian, preferably Newtonian. Preferably, the composition has an initial viscosity of from 10 mPa·s to 10,000 mPa·s, preferably from 100 mPa·s to 5,000 mPa·s, more preferably from 300 mPa·s to 2,000 mPa·s, or most preferably from 500 mPa·s to 1,500 mPa·s, alternatively combinations thereof. Viscosity is measured with a Brookfield RT Viscometer using spindle 21 at 20 RPM at 25° C.

The detergent composition of the invention is especially suitable for use as a hand dishwashing detergent. Due to its desirable sudsing profile, it is extremely suitable for use in diluted form in a full sink of water to wash dishes. It can also be used when dosed directly on soiled dishware or on an optionally prewetted cleaning implement preferably a sponge.

Triblock Co-Polymer

The alkylene oxide triblock copolymer of the present invention is defined as a triblock co-polymer having alkylene oxide moieties according to Formula (I): (EO)x (PO)y(EO)x, wherein EO represents ethylene oxide, and each x represents the number of EO units within the EO block. Each x is independently on average between 1 and 40, preferably between 3 and 35, more preferably between 3 and 30, even more preferably between 3 and 20, most preferably between 3 and 10. Preferably x is the same for both EO blocks, wherein the "same" means that the x between the two EO blocks varies within maximum of 2 units, preferably within a maximum of 1 unit, preferably both x's are the same number of units. PO represents propylene oxide, and y represents the number of PO units in the PO block. Each y is on average between 1 and 15, preferably between 5 and 15.

Preferably, the triblock co-polymer has a ratio of y to each x of from 1:1 to 3:1, preferably from 1.5:1 to 2.5:1. The triblock co-polymer preferably has a ratio of y to average x of 2 EO blocks of from 1:1 to 3:1, preferably from 1.5:1 to 2.5:1. Preferably the triblock co-polymer has an average weight percentage of total EO of between 30% and 50% by weight of the triblock co-polymer. Preferably the triblock co-polymer has an average weight percentage of total PO of between 50% and 70% by weight of the triblock co-polymer. It is understood that the average total weight % of EO and PO for the triblock co-polymers add up to 100%. The triblock co-polymer has an average molecular weight of between 140 and 4400, preferably between 400 and 2700, more preferably between 550 and 1800. Average molecular weight is determined using a 1H NMR spectroscopy (see Thermo scientific application note No. AN52907). It is an established tool for polymer characterization, including molecular weight determination and co-polymer composition analysis.

"Block co-polymers" as used herein is meant to encompass co-polymers including two or more different homopolymeric and/or monomeric units, i.e. "building blocks", which are linked to form a single polymer molecule. In this case, the block co-polymers are in the form of tri-block co-polymers. Triblock co-polymers have the basic structure ABA, wherein A and B are different homopolymeric and/or monomeric units. In this case A is ethylene oxide (EO) and B is propylene oxide (PO). Those skilled in the art will recognize the phrase "block co-polymers" is synonymous with this definition of "block polymers".

"Building Blocks" herein is meant homopolymeric units and/or monomeric units that polymerize with one another to form block co-polymers. Suitable building blocks in accordance with the present invention are alkylene oxide moieties, more particularly ethylene oxide and propylene oxide moieties. The different homopolymeric units present in block copolymers retain some of their respective individual, original properties even though they are linked to one or more different homopolymeric units. Block co-polymers are known to exhibit properties that are different from those of homopolymers, random co-polymers, and polymer blends. The properties of block co-polymers themselves also differ depending on the length and chemical composition of the blocks making up the block co-polymer. Accordingly, the properties of a block co-polymer are influenced by the arrangement of the blocks within the block polymer. For example, a polymer such as: hydrophobic block-hydrophilic block-hydrophobic block will exhibit properties that are different than a block polymer such as: hydrophilic block-hydrophobic block-hydrophilic block. The applicant has now surprisingly found that a triblock copolymer according to Formula (I) with the specific EO/PO/EO arrangement and respective homopolymeric lengths enhances suds mileage performance of a liquid hand dishwashing detergent composition in presence of greasy soils and/or suds consistency through dilution throughout the washing process. Although not wishing to be bound by theory, it is believed that these triblock co-polymers provide the right hydrophilic hydrophobic balance to position themselves at the grease-water and air-water interface. The hydrophobic PO block can nicely pack itself along the grease or air surface while the dual hydrophilic end tails can reach out to the water phase as such stabilizing the grease in water emulsion and/or air in water suspension, e.g. suds, accordingly.

EO-PO-EO triblock co-polymers are commercially available from BASF such as Pluronic® PE series, and from the Dow Chemical company such as Tergitol™ L series.

The preparation method for such tri-block co-polymers is well known to polymer manufacturers and is not the subject of the present invention.

Preferred triblock co-polymers are readily biodegradable under aerobic conditions. Aerobic biodegradation is measured by the production of carbon dioxide (C02) from the test material in the standard test method as defined by Method 301B test guidelines of the Organization for Economic Cooperation and Development (OECD). The preferred polymers should achieve at least 60% of biodegradation as measured by C02 production in 28 days in the standard Method 301B. These OECD test method guidelines are well known in the art and cited herein as a reference (OECD, 1986).

The tri-block co-polymers according to the invention are present in the composition at a level of from 0.1% to 10%, preferably from 0.5% to 7.5%, more preferably from 1% to 5%, by weight of the total composition.

Surfactant System

The cleaning composition comprises from 1% to 60%, preferably from 5% to 50%, more preferably from 8% to 45%, most preferably from 15% to 40%, by weight of the total composition of a surfactant system. The surfactant system comprises an anionic surfactant and a primary co-surfactant.

Anionic Surfactant

Preferably, the surfactant system for the cleaning composition of the present invention comprises from 60% to 90%, preferably from 65% to 85%, more preferably from 70% to 80%, by weight of the surfactant system of an anionic surfactant. The anionic surfactant can be any anionic cleaning surfactant, preferably selected from sulphate and/or sulfonate and/or sulfosuccinate anionic surfactants. Especially preferred anionic surfactant is selected from the group comprising an alkyl sulfate, an alkyl alkoxy sulfate preferably an alkyl ethoxy sulfate, or mixtures thereof. Preferred anionic surfactant is an alkyl ethoxy sulfate, or a mixed alkyl sulfate-alkyl ethoxy sulfate anionic surfactant system, with a mol average ethoxylation degree of less than 5, preferably less than 3, more preferably less than 2 and more than 0.5.

Preferably the alkyl ethoxy sulfate, or mixed alkyl sulfate-alkyl ethoxy sulfate, anionic surfactant has a weight average level of branching of from about 5% to about 60%, preferably from about 10% to about 50%, more preferably from about 20% to about 40%. This level of branching contributes to better dissolution and suds lasting. It also contributes to the stability of the detergent at low temperature. Preferably the alkyl ethoxy sulfate anionic surfactant, or mixed alkyl sulfate-alkyl ethoxy sulfate anionic surfactant, has an average alkyl carbon chain length of from 8 to 16, preferably from 12 to 15, more preferably from 12 to 14, and preferably a weight average level of branching between 25 and 45%. Detergents having this ratio present good dissolution and suds performance.

When the alkyl ethoxylated sulfate anionic surfactant is a mixture, the average alkoxylation degree is the mol average alkoxylation degree of all the components of the mixture (i.e., mol average alkoxylation degree). In the mol average alkoxylation degree calculation the weight of sulfate anionic surfactant components not having alkoxylate groups should also be included.

$$\text{Mol average alkoxylation degree}=(x1*\text{alkoxylation degree of surfactant 1}+x2*\text{alkoxylation degree of surfactant 2}+\ldots)/(x1+x2+\ldots)$$

wherein x1, x2, . . . are the number of moles of each sulfate anionic surfactant of the mixture and alkoxylation degree is the number of alkoxy groups in each sulfate anionic surfactant.

If the surfactant is branched, the preferred branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the sulfate anionic surfactant used in the composition of the invention.

The branched sulfate anionic surfactant can be a single anionic surfactant or a mixture of anionic surfactants. In the case of a single surfactant the percentage of branching refers to the weight percentage of the hydrocarbyl chains that are branched in the original alcohol from which the surfactant is derived.

In the case of a surfactant mixture the percentage of branching is the weight average and it is defined according to the following formula:

$$\text{Weight average of branching (\%)}=[(x1*\text{wt \% branched alcohol 1 in alcohol 1}+x2*\text{wt \% branched alcohol 2 in alcohol 2}+\ldots)/(x1+x2+\ldots)]*100$$

wherein x1, x2, are the weight in grams of each alcohol in the total alcohol mixture of the alcohols which were used as starting material for the anionic surfactant for the detergent of the invention. In the weight average branching degree calculation, the weight of anionic surfactant components not having branched groups should also be included.

Suitable counterions include alkali metal cation earth alkali metal cation, alkanolammonium or ammonium or substituted ammonium, but preferably sodium.

Suitable examples of commercially available sulfates include, those based on Neodol alcohols ex the Shell company, Lial-Isalchem and Safol® ex the Sasol company, natural alcohols ex The Procter & Gamble Chemicals company. Suitable sulfonate surfactants for use herein include water-soluble salts of C8-C18 alkyl or hydroxyalkyl sulfonates; C11-C18 alkyl benzene sulfonates (LAS), modified alkylbenzene sulfonate (MLAS); methyl ester sulfonate (MES); and alpha-olefin sulfonate (AOS). Those also include the paraffin sulfonates may be monosulfonates and/or disulfonates, obtained by sulfonating paraffins of 10 to 20 carbon atoms. The sulfonate surfactant also include the alkyl glyceryl sulfonate surfactants.

Co-Surfactant

The surfactant system of the composition of the present invention comprises a primary co-surfactant. The composition preferably comprises from 0.1% to 20%, more preferably from 0.5% to 15%, and especially from 2% to 10% by weight of the detergent composition of the primary co-surfactant. Preferably, the surfactant system for the detergent composition of the present invention comprises from 10% to 40%, preferably from 15% to 35%, more preferably from 20% to 30%, by weight of the surfactant system of a primary co-surfactant. As used herein, the term "primary co-surfactant" means the non-anionic surfactant present at the highest level amongst all the co-surfactants co-formulated with the anionic surfactant. The primary co-surfactant is selected from the group consisting of an amphoteric surfactant, a zwitterionic surfactant, and mixtures thereof.

The composition of the present invention will preferably comprise an amine oxide as the amphoteric surfactant. Preferably, the amine oxide surfactant is selected from the group consisting of a linear or branched alkyl amine oxide surfactant, a linear or branched alkyl amidopropyl amine oxide surfactant, and mixtures thereof, more preferably a linear alkyl dimethyl amine oxide surfactant, even more preferably a linear C10 alkyl dimethyl amine oxide surfactant, a linear C12-C14 alkyl dimethyl amine oxide surfactant, and mixtures thereof, most preferably a linear C12-C14 alkyl dimethyl amine oxide surfactant.

Preferably, the amine oxide surfactant is alkyl dimethyl amine oxide or alkyl amido propyl dimethyl amine oxide, preferably alkyl dimethyl amine oxide and especially coco dimethyl amino oxide, most preferably C12-C14 alkyl dimethyl amine oxide.

Alternatively, the amine oxide surfactant is a mixture of amine oxides comprising a low-cut amine oxide and a mid-cut amine oxide. The amine oxide of the composition of the invention then comprises:

a) from about 10% to about 45% by weight of the amine oxide of low-cut amine oxide of formula R1R2R3AO wherein R1 and R2 are independently selected from hydrogen, C1-C4 alkyls or mixtures thereof, and R3 is selected from C10 alkyls or mixtures thereof; and b) from 55% to 90% by weight of the amine oxide of mid-cut amine oxide of formula R4R5R6AO wherein R4 and R5 are independently selected from hydrogen, C1-C4 alkyls or mixtures thereof, and R6 is selected from C12-C16 alkyls or mixtures thereof In a preferred low-cut amine oxide for use herein R3 is n-decyl. In another preferred low-cut amine oxide for use herein R1 and R2 are both methyl. In an especially preferred low-cut amine oxide for use herein R1 and R2 are both methyl and R3 is n-decyl.

Preferably, the amine oxide comprises less than about 5%, more preferably less than 3%, by weight of the amine oxide of an amine oxide of formula R7R8R9AO wherein R7 and R8 are selected from hydrogen, C1-C4 alkyls and mixtures thereof and wherein R9 is selected from C8 alkyls and mixtures thereof. Compositions comprising R7R8R9AO tend to be unstable and do not provide very suds mileage.

Preferably, the zwitterionic surfactant is a betaine surfactant. Suitable betaine surfactant includes alkyl betaines, alkylamidobetaine, amidazoliniumbetaine, sulfobetaine (INCI Sultaines) as well as the Phosphobetaine and preferably meets Formula (I):

$$R^1—[CO—X(CH_2)_n]_x—N^+(R^2)(R_3)—(CH_2)_m—[CH(OH)—CH_2]_y—Y— \quad (I)$$

wherein

R1 is a saturated or unsaturated C6-22 alkyl residue, preferably C8-18 alkyl residue, in particular a saturated C10-16 alkyl residue, for example a saturated C12-14 alkyl residue;

X is NH, NR4 with C1-4 Alkyl residue R4, O or S, n is a number from 1 to 10, preferably 2 to 5, in particular 3, x is 0 or 1, preferably 1, R2 and R3 are independently a C1-4 alkyl residue, potentially hydroxy substituted such as a hydroxyethyl, preferably a methyl, m is a number from 1 to 4, in particular 1, 2 or 3, y is 0 or 1, and Y is COO, SO3, OPO(OR5)O or P(O)(OR5)O, whereby R5 is a hydrogen atom H or a C1-4 alkyl residue.

Preferred betaines are the alkyl betaines of the Formula (Ia), the alkyl amido propyl betaine of the Formula (Ib), the Sulfo betaines of the Formula (Ic) and the Amido sulfobetaine of the Formula (Id):

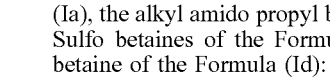

$$R^1—N(CH_3)_2—CH_2COO^- \quad (Ia)$$

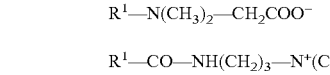

$$R^1—CO—NH(CH_2)_3—N^+(CH_3)_2—CH_2COO^{31} \quad (Ib)$$

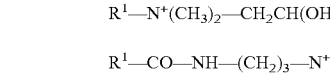

$$R^1—N^+(CH_3)_2—CH_2CH(OH)CH_2SO_3— \quad (Ic)$$

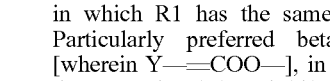

$$R^1—CO—NH—(CH_2)_3—N^+(CH_3)_2—CH_2CH(OH)CH_2SO_3— \quad (Id)$$

in which R1 has the same meaning as in Formula (I). Particularly preferred betaines are the Carbobetaine [wherein Y—═COO—], in particular the Carbobetaine of the Formulae (Ia) and (Ib), more preferred are the Alkylamidobetaine of the Formula (Ib).

A preferred betaine is, for example, cocoamidopropylbetaine.

Preferably, the surfactant system of the composition of the present invention comprises a surfactant system wherein the weight ratio of the anionic surfactant to the primary co-surfactant, preferably the anionic surfactant to the amine oxide surfactant is less than 9:1, more preferably from 5:1 to 1:1, more preferably from 4:1 to 2:1.

Non-Ionic Surfactant

Preferably, the surfactant system of the composition of the present invention further comprises from 0.1% to 10% by weight of the total composition of a secondary co-surfactant system. As used herein, the term "secondary co-surfactant" means the co-surfactant present at the second highest level asides from the anionic surfactant as the main surfactant, i.e., anionic surfactant present at the highest level and the amphoteric/zwitterionic/mixtures thereof as primary co-surfactant. Preferably the secondary co-surfactant system comprises a non-ionic surfactant. Preferably, the surfactant system of the composition of the present invention further comprises from about 1% to about 25%, preferably from about 1.25% to about 20%, more preferably from about 1.5% to about 15%, most preferably from about 1.5% to about 5% by weight of the surfactant system, of a non-ionic surfactant. Preferably, the non-ionic surfactant is a linear or branched, primary or secondary alkyl alkoxylated non-ionic surfactant, preferably an alkyl ethoxylated non-ionic surfactant, preferably comprising on average from 9 to 15, preferably from 10 to 14 carbon atoms in its alkyl chain and on average from 5 to 12, preferably from 6 to 10, most preferably from 7 to 8, units of ethylene oxide per mole of alcohol. Other suitable non-ionic surfactants for use herein include fatty alcohol polyglycol ethers, alkylpolyglucosides and fatty acid glucamides, preferably alkylpolyglucosides. Preferably the alkyl polyglucoside surfactant is a C8-C16 alkyl polyglucoside surfactant, preferably a C8-C14 alkyl polyglucoside surfactant, preferably with an average degree of polymerization of between 0.1 and 3, more preferably between 0.5 and 2.5, even more preferably between 1 and 2. Most preferably the alkyl polyglucoside surfactant has an average alkyl carbon chain length between 10 and 16, preferably between 10 and 14, most preferably between 12 and 14, with an average degree of polymerization of between 0.5 and 2.5 preferably between 1 and 2, most preferably between 1.2 and 1.6. C8-C16 alkyl polyglucosides are commercially available from several suppliers (e.g., Simusol® surfactants from Seppic Corporation; and Glucopon® 600 CSUP, Glucopon® 650 EC, Glucopon® 600 CSUP/MB, and Glucopon® 650 EC/MB, from BASF Corporation). Preferably, the composition comprises the anionic surfactant and the non-ionic surfactant in a ratio of from 2:1 to 50:1, preferably 2:1 to 10:1.

Amphiphilic Polymer

The composition of the present invention may further comprise from 0.01% to 5%, preferably from 0.05% to 2%, more preferably from 0.07% to 1% by weight of the total composition of an amphiphilic polymer selected from the groups consisting of amphiphilic alkoxylated polyalkyleneimine and mixtures thereof, preferably an amphiphilic alkoxylated polyalkyleneimine.

Preferably, the amphiphilic alkoxylated polyalkyleneimine is an alkoxylated polyethyleneimine polymer comprising a polyethyleneimine backbone having average molecular weight range from 100 to 5,000, preferably from 400 to 2,000, more preferably from 400 to 1,000 Daltons and the alkoxylated polyethyleneimine polymer further comprising:

(i) one or two alkoxylation modifications per nitrogen atom by a polyalkoxylene chain having an average of about 1 to about 50 alkoxy moieties per modification, wherein the terminal alkoxy moiety of the alkoxylation modification is capped with hydrogen, a C1-C4 alkyl or mixtures thereof;

(ii) an addition of one C1-C4 alkyl moiety and one or two alkoxylation modifications per nitrogen atom by a polyalkoxylene chain having an average of about 1 to about 50 alkoxy moieties per modification wherein the terminal alkoxy moiety is capped with hydrogen, a C1-C4 alkyl or mixtures thereof; or (iii) a combination thereof; and wherein the alkoxy moieties comprises ethoxy (EO) and/or propxy (PO) and/or butoxy (BO) and wherein when the alkoxylation modification comprises EO it also comprises PO or BO.

Preferred amphiphilic alkoxylated polyethyleneimine polymers comprise EO and PO groups within their alkoxylation chains, the PO groups preferably being in terminal position of the alkoxy chains, and the alkoxylation chains preferably being hydrogen capped.

For example, but not limited to, below is shown possible modifications to terminal nitrogen atoms in the polyethyleneimine backbone where R represents an ethylene spacer and E represents a C1-C4 alkyl moiety and X− represents a suitable water soluble counterion.

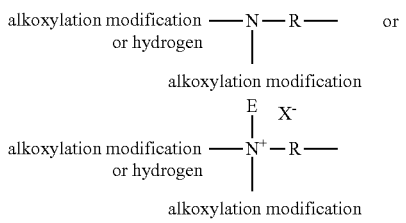

Also, for example, but not limited to, below is shown possible modifications to internal nitrogen atoms in the polyethyleneimine backbone where R represents an ethylene spacer and E represents a $C_1$-$C_4$ alkyl moiety and X− represents a suitable water soluble counterion.

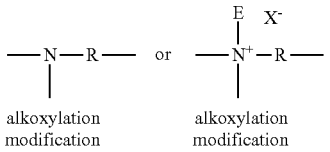

The alkoxylation modification of the polyethyleneimine backbone consists of the replacement of a hydrogen atom by a polyalkoxylene chain having an average of about 1 to about 50 alkoxy moieties, preferably from about 20 to about 45 alkoxy moieties, most preferably from about 30 to about 45 alkoxy moieties. The alkoxy moieties are selected from ethoxy (EO), propoxy (PO), butoxy (BO), and mixtures thereof. Alkoxy moieties solely comprising ethoxy units are outside the scope of the invention though. Preferably, the polyalkoxylene chain is selected from ethoxy/propoxy block moieties. More preferably, the polyalkoxylene chain is ethoxy/propoxy block moieties having an average degree of ethoxylation from about 3 to about 30 and an average degree of propoxylation from about 1 to about 20, more preferably ethoxy/propoxy block moieties having an average degree of ethoxylation from about 20 to about 30 and an average degree of propoxylation from about 10 to about 20.

More preferably the ethoxy/propoxy block moieties have a relative ethoxy to propoxy unit ratio between 3 to 1 and 1 to 1, preferably between 2 to 1 and 1 to 1. Most preferably the polyalkoxylene chain is the ethoxy/propoxy block moieties wherein the propoxy moiety block is the terminal alkoxy moiety block.

The modification may result in permanent quaternization of the polyethyleneimine backbone nitrogen atoms. The degree of permanent quaternization may be from 0% to about 30% of the polyethyleneimine backbone nitrogen atoms. It is preferred to have less than 30% of the polyethyleneimine backbone nitrogen atoms permanently quaternized. Most preferably the degree of quaternization is about 0%.

A preferred polyethyleneimine has the general structure of Formula (II):

wherein the polyethyleneimine backbone has a weight average molecular weight of about 600, n of formula (II) has an average of about 10, m of formula (II) has an average of about 7 and R of formula (II) is selected from hydrogen, a $C_1$-$C_4$ alkyl and mixtures thereof, preferably hydrogen. The degree of permanent quaternization of formula (II) may be from 0% to about 22% of the polyethyleneimine backbone nitrogen atoms. The molecular weight of this polyethyleneimine preferably is between 10,000 and 15,000.

An alternative polyethyleneimine has the general structure of Formula (II) but wherein the polyethyleneimine backbone has a weight average molecular weight of about 600, n of Formula (II) has an average of about 24, m of Formula (II) has an average of about 16 and R of Formula (II) is selected from hydrogen, a $C_1$-$C_4$ alkyl and mixtures thereof, preferably hydrogen. The degree of permanent quaternization of Formula (II) may be from 0% to about 22% of the polyethyleneimine backbone nitrogen atoms. The molecular weight of this polyethyleneimine preferably is between 25,000 and 30,000.

Most preferred polyethyleneimine has the general structure of Formula (II) wherein the polyethyleneimine backbone has a weight average molecular weight of about 600, n of Formula (II) has an average of about 24, m of Formula (II) has an average of about 16 and R of Formula (II) is hydrogen. The degree of permanent quaternization of Formula (II) is 0% of the polyethyleneimine backbone nitrogen atoms. The molecular weight of this polyethyleneimine preferably is about from about 25,000 to 30,000, most preferably about 28,000.

These polyethyleneimines can be prepared, for example, by polymerizing ethyleneimine in the presence of a catalyst such as carbon dioxide, sodium bisulfite, sulfuric acid, hydrogen peroxide, hydrochloric acid, acetic acid, and the like, as described in more detail in PCT Publication No. WO 2007/135645.

Cyclic Polyamine

The cyclic polyamine of the invention is a cleaning polyamine. The cleaning polyamine comprises amine functionalities that helps cleaning as part of a detergent composition. The composition of the invention preferably comprises from 0.1% to 10%, more preferably from 0.2% to 5%, (II)

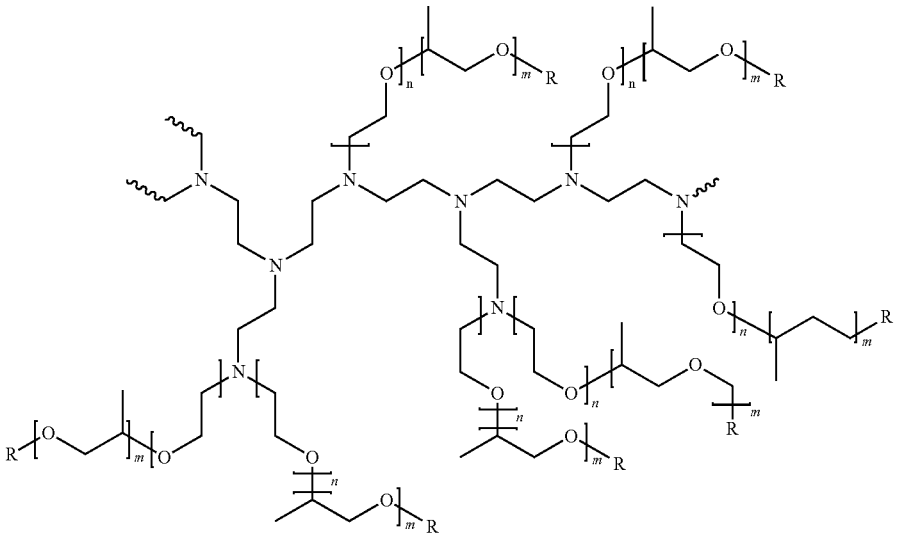

and especially from 0.3% to 2%, by weight of the composition, of the cyclic polyamine.

The term "cyclic amine" herein encompasses a single amine and a mixture thereof. The amine can be subjected to protonation depending on the pH of the cleaning medium in which it is used. The cyclic polyamine of the invention conforms to the following Formula (I):

(I)

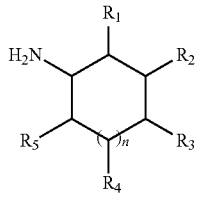

wherein $R_1$, $R_2$, $R_3$, $R_4$ and $R_5$ are independently selected from the group consisting of NH2, —H, linear or branched alkyl having from 1 to 10 carbon atoms, and linear or branched alkenyl having from 1 to 10 carbon atoms, n is from 0 to 3, preferably n is 1, and wherein at least one of the Rs is NH2 and the remaining "Rs" are independently selected from the group consisting of NH2, —H, linear or branched alkyl having 1 to 10 carbon atoms, and linear or branched alkenyl having from 1 to 10 carbon atoms. Preferably, the cyclic polyamine is a diamine, wherein n is 1, $R_2$ is NH2, and at least one of $R_1$, $R_3$, $R_4$ and $R_5$ is CH3 and the remaining Rs are H.

The amine of the invention is a cyclic amine with at least two primary amine functionalities. The primary amines can be in any position in the cyclic amine but it has been found that in terms of grease cleaning, better performance is obtained when the primary amines are in positions 1,3. It has also been found that cyclic amines in which one of the substituents is —CH3 and the rest are H provided for improved grease cleaning performance.

Accordingly, the most preferred cyclic polyamine for use with the cleaning composition of the present invention are cyclic polyamine selected from the group consisting of 2-methylcyclohexane-1,3-diamine, 4-methylcyclohexane-1,3-diamine and mixtures thereof. The inventors have surprisingly found that these specific cyclic polyamine works to improve suds profile through-out the dishwashing process when formulated together with the specific triblock copolymers of Formula (I) according to the present invention.

The composition of the present invention may comprise at least one active selected from the group consisting of: i) a salt, ii) a hydrotrope, iii) an organic solvent, and mixtures thereof.

Salt

The composition of the present invention may comprise from 0.05% to 2%, preferably from 0.1% to 1.5%, or more preferably from 0.5% to 1%, by weight of the total composition of a salt, preferably a monovalent, divalent inorganic salt or a mixture thereof, more preferably sodium chloride, sodium sulphate or a mixture thereof, most preferably sodium chloride.

Hydrotrope

The composition of the present invention may comprise from 0.1% to 10%, or preferably from 0.5% to 10%, or more preferably from 1% to 10% by weight of the total composition of a hydrotrope or a mixture thereof, preferably sodium cumene sulfonate.

Organic Solvent

The composition of the present invention may comprise an organic solvent. Suitable organic solvents include C4-14 ethers and diethers, polyols, glycols, alkoxylated glycols, C6-C16 glycol ethers, alkoxylated aromatic alcohols, aromatic alcohols, aliphatic linear or branched alcohols, alkoxylated aliphatic linear or branched alcohols, alkoxylated C1-C5 alcohols, C8-C14 alkyl and cycloalkyl hydrocarbons and halohydrocarbons, and mixtures thereof. Preferably the organic solvents include alcohols, glycols, and glycol ethers, alternatively alcohols and glycols. The composition comprises from 0% to less than 50%, preferably from 0.01% to 25%, more preferably from 0.1% to 10%, or most preferably from 0.5% to 5%, by weight of the total composition of an organic solvent, preferably an alcohol, more preferably ethanol, a polyalkyleneglycol, more preferably polypropyleneglycol, and mixtures thereof.

Adjunct Ingredients

The detergent composition herein may optionally comprise a number of other adjunct ingredients such as builders (e.g., preferably citrate), chelants, conditioning polymers, cleaning polymers, surface modifying polymers, soil flocculating polymers, structurants, emollients, humectants, skin rejuvenating actives, enzymes, carboxylic acids, scrubbing particles, bleach and bleach activators, perfumes, malodor control agents, pigments, dyes, opacifiers, beads, pearlescent particles, microcapsules, inorganic cations such as alkaline earth metals such as Ca/Mg-ions, antibacterial agents, preservatives, viscosity adjusters (e.g., salt such as NaCl, and other mono-, di- and trivalent salts) and pH adjusters and buffering means (e.g. carboxylic acids such as citric acid, HCl, NaOH, KOH, alkanolamines, phosphoric and sulfonic acids, carbonates such as sodium carbonates, bicarbonates, sesquicarbonates, borates, silicates, phosphates, imidazole and alike).

The elements of the composition of the invention described in connexion with the first aspect of the invention apply mutatis mutandis to the other aspects of the invention.

Method of Washing

In another aspect, the invention is directed to a method of manually washing dishware with the composition of the present invention. The method comprises the steps of: i) delivering a composition of the present invention onto the dishware or a cleaning implement; ii) cleaning the dishware with the composition in the presence of water; and iii) optionally, rinsing the dishware. The delivering step is preferably either directly onto the dishware surface or onto a cleaning implement, i.e., in a neat form. The cleaning device or implement is preferably wet before or after the composition is delivered to it. Especially good grease removal has been found when the composition is used in neat form. Alternatively the user pre-dilutes the neat product of the composition of the invention in water prior to immersing and washing the soiled dishware therein, followed by an optional rinsing step.

By "rinsing", it is meant herein contacting the dishware cleaned with the process according to the present invention with substantial quantities of appropriate solvent, typically water. By "substantial quantities", it is meant usually about 1 to about 20 L.

Another aspect of the present invention is directed to the use of a liquid hand dishwashing detergent composition of the present invention for providing good sudsing profile, including enhanced suds stabilization of the composition in the presence of greasy soils and/or enhanced suds consistency of the composition through dilution throughout the washing process.

Test Methods

The following assays set forth must be used in order that the invention described and claimed herein may be more fully understood.

Test Method 1: Suds Mileage Test

The objective of the Suds Mileage Test is to compare the evolution over time of suds volume generated for different test formulations at specified water hardness, solution temperatures and formulation concentrations, while under the influence of periodic soil injections. Data are compared and expressed versus a reference composition as a suds mileage index (reference composition has suds mileage index of 100). The steps of the method are as follows:

1. A defined amount of a test composition, depending on the targeted composition concentration (here: 0.12 wt %), is dispensed through a plastic pipette at a flow rate of 0.67 mL/sec at a height of 37 cm above the bottom surface of a sink (dimension: 300 mm diameter and 288 mm height) into a water stream (here: water hardness: 15 gpg, water temperature: 35° C.) that is filling up the sink to 4 L with a constant pressure of 4 bar.
2. An initial suds volume generated (measured as average foam height X sink surface area and expressed in $cm^3$) is recorded immediately after end of filling.
3. A fixed amount (6 mL) of a greasy soil with defined composition per Table 1 below is immediately injected into the middle of the sink.
4. The resultant solution is mixed with a metal blade (10 cm×5 cm) positioned in the middle of the sink at the air liquid interface under an angle of 45 degrees rotating at 85 RPM for 20 revolutions.
5. Another measurement of the total suds volume is recorded immediately after end of blade rotation.
6. Steps 3-5 are repeated until the measured total suds volume reaches a minimum level of 400 $cm^3$. The amount of added soil that is needed to get to the 400 $cm^3$ level is considered as the suds mileage for the test composition.
7. Each test composition is tested 4 times per testing condition (i.e., water temperature, composition concentration, water hardness, soil type).
8. The average suds mileage is calculated as the average of the 4 replicates for each sample for a defined test condition.
9. Calculate a Suds Mileage Index by comparing the average mileage of a test composition sample versus a reference composition sample. The calculation is as follows:

$$\text{Suds Mileage Index} = \frac{\text{Average number of soil additions of test composition}}{\text{Average number of soil additions of reference composition}} \times 100$$

Soil compositions are produced through standard mixing of the components described in Table 1.

TABLE 1

| Greasy Soil | |
|---|---|
| Ingredient | Weight % |
| Crisco Oil | 12.730% |
| Crisco shortening | 27.752% |
| Lard | 7.638% |
| Refined Rendered Edible Beef Tallow | 51.684% |

TABLE 1-continued

| Greasy Soil | |
|---|---|
| Ingredient | Weight % |
| Oleic Acid, 90% (Techn) | 0.139% |
| Palmitic Acid, 99+% | 0.036% |
| Stearic Acid, 99+% | 0.021% |

Test Method 2: Suds Rheology Test

The suds rheology test aims at measuring physical characteristics of suds, representative for suds consistency and overall consumer acceptability of the suds generated from a detergent composition when applied and agitated on a sponge through manual squeezing action.

When measuring the suds rheology for different product concentrations, the sustainability of suds aesthetics for the product upon dilution with wash water through-out the wash process is also determined. The test is conducted by the following steps:

1. For each test product, 30 g of aqueous wash solutions (15 dH water hardness, 20° C.) of the targeted product concentrations (e.g., 10%, 1%) are prepared.
2. Synthetic dishwashing sponges (Brand: Delhaize Belgium scour sponges with grip—dimensions: length 9.5 cm, width 6.5 cm and height 4.5 cm, item number 17152/0000) are pre-conditioned by washing them without detergent during 3 cycles of 32 mins at 40° C. and 15 dH water hardness in a laundry washing machine (Brand: Miele Softronic W3205—Express cycle).
3. The washed sponges are left to dry for 2 days under a fume food (Brand: Kötermann type 2-453-GAHB) with air flow 0.64 m/sec under standard lab conditions (e.g., 20-22° C., 40-60% rH).
4. The respective 30 g wash solution is distributed homogeneously over the soft side opposite to the scouring side of the dry sponge, allowing the wash solution to completely submerge into the sponge for 20 seconds.
5. While wearing latex lab gloves and while holding the scouring side down, the sponge is manually squeezed 5 times with maximum power (i.e., frequency 1 squeeze per second) after which the generated suds on the sponge is collected in a cup and transferred with a spatula onto the serrated peltier plate of the rheometer (TA Rheometer DHR1) such that the entire serrated peltier plate surface is covered with suds.
6. The suds rheology is measured with a serrated parallel plate (both top and bottom serrated geometry) at a gap of 1000 μm and following a peak hold procedure at 20° C., at shear rate 1/s with a duration of 300 seconds measuring 600 data points (Stress constant=79577.5 Pa/N·m, Strain constant=20 1/rad). The value measured after 1 second is reported as the static yield stress.
7. 3 replicates are run for each test product at each product concentration and the measured static yield stress values are averaged per product and per product concentration. For each product concentration and replicate, a new dry sponge is used and all tests are run by the same expert operator.

The Δ Yield Stress between 2 different product concentrations is calculated by subtracting the Static Yield Stress value of the lower product concentration from the Static Yield Stress value of the higher product concentration, according to the formula described below:

Δ Yield Stress (X %−Y %)=Static Yield Stress at X % product concentration−Static Yield Stress at Y % product concentration

EXAMPLE

The following examples are provided to further illustrate the present invention and are not to be construed as limitations of the present invention, as many variations of the present invention are possible without departing from its spirit or scope.

Example 1: Inventive and Comparative Compositions

The ability of cleaning compositions to maintain their suds volume in presence of greasy soil is assessed using the Suds Mileage test described herein for detergent compositions having an EO-PO-EO triblock co-polymer according to the invention (Inventive Compositions 1-2, respectively). In parallel, a Comparative Composition 1 having an EO-PO-EO triblock co-polymer outside the scope of the present invention is also assessed. Reference Composition 1 is directed to a cleaning composition single variably lacking an EO-PO-EO triblock co-polymer. The ability of cleaning compositions to sustain their suds consistency throughout dilution during the wash process has also been assessed using the Suds Rheology test described herein. The foregoing compositions are produced through standard mixing of the components described in Table 2.

TABLE 2

Inventive, Comparative and Reference Compositions

| As 100% active | Inventive Comp. 1 | Inventive Comp. 2 | Comparative Comp. 1 | Reference Comp. 1 |
|---|---|---|---|---|
| C1213AE0.6S (Avg. branching: 22% or 33% branching) | 20.4% | 20.4% | 20.4% | 20.4% |
| C1214 dimethyl amine oxide | 6.8% | 6.8% | 6.8% | 6.8% |
| (EO)5(PO)10(EO)5 | 2% | — | — | — |
| (EO)25(PO)10(EO)25 | — | 2% | — | — |
| Pluronic L44 (EO)11(PO)21(EO)11 | — | — | 2% | — |
| ethanol | 2.0% | 2.0% | 2.0% | 2.0% |
| NaCl | 0.7% | 0.7% | 0.7% | 0.7% |
| Polypropyleneglycol (MW2000) | 0.7% | 0.7% | 0.7% | 0.7% |
| Water + Minor ingredients (perfume, dye, preservatives) | Balance to 100% | Balance to 100% | Balance to 100% | Balance to 100% |
| pH (at 10% product concentration in demineralized water - with NaOH trimming) | 9.0 | 9.0 | 9.0 | 9.0 |

Test Results: Suds Mileage Index and Suds Rheology Profile of Inventive and Comparative Compositions The resultant compositions including the Inventive Compositions 1-2 and Comparative Composition 1 are assessed versus the Reference Composition 1 according to the Suds Mileage Index and Suds Rheology test methods as described herein. The Suds Mileage Index and suds rheology results of the test are summarized in Table 3. The higher the Suds Mileage Index value, the better in maintaining suds mileage. The lower the suds rheology delta yield stress the more consistent the suds are throughout dilution. From the data it can be concluded that the Inventive Compositions 1-2, and especially Inventive Composition 1, according to the invention, and contrary to the Comparative Composition 1 outside the scope of the invention, have an improved suds consistency profile compared to the Reference Composition 1, at equal to improved suds mileage performance. As such, the EO-PO-EO block copolymers of use in the formulae of the present invention result in an improved suds consistency throughout dilution in a manual dishwashing operation when applied on a sponge without compromising on suds mileage. As can be seen by comparing the Suds Mileage Index and Yield Stress change delivered by comparative composition 1 in contrast to reference composition 1, while the addition of alternative EO-PO-EO block copolymers results in an improvement in suds mileage, this is at the expense of suds stability, as measured by the change in yield stress upon dilution.

TABLE 3

Suds Mileage Index and Suds Rheology Results of Inventive and Comparative Compositions

| | Inventive Comp. 1 | Inventive Comp. 2 | Comparative Comp. 1 | Reference Comp. 1 |
|---|---|---|---|---|
| Suds Mileage Index (Greasy soil)* | 109 | 100 | 107 | 100 |
| Δ Yield Stress (10%-1%)** | 0.82 | 1.76 | 2.26 | 2.09 |

*Generated with formulations from table 2, comprising an AES with 33% avg branching.
**Generated with formulations from table 2, comprising an AES with 22% avg branching.

All percentages and ratios herein are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A liquid hand dishwashing detergent composition comprising:

a) from about 15% to about 40%, by weight of the total composition of a surfactant system, the surfactant system comprises:
   i) an anionic surfactant selected from the group consisting of C12-C15 alkyl sulfate, C12-C15 alkyl ethoxy sulfate, and mixtures thereof, and
   ii) a primary co-surfactant, wherein the primary co-surfactant is a linear or branched C12-C14 amine oxide surfactant; and b) from about 0.1% to about 10%, by weight of the total composition of at least one ethyleneoxide (EO)-propyleneoxide (PO)-ethyleneoxide (EO) triblock co-polymer of Formula (I):

$$(EO)x\text{-}(PO)y\text{-}(EO)x \quad (I)$$

wherein:

each x is independently on average between 5 and 25; and y is on average between 5 and 10;

wherein the pH of the composition is from about 7.5 to about 10 as measured at 10% dilution in distilled water at 20° C.

2. The composition according to claim 1 wherein the triblock co-polymer has a ratio of y to each x of from about 1:1 to about 2:1.

3. The composition according to claim 2 wherein the triblock co-polymer has a ratio of y to each x of from about 1.5:1 to about 2:1.

4. The composition according to claim 1 wherein the triblock co-polymer has an average weight percentage of total EO of between about 30% and about 50% by weight of the tri-block co-polymer.

5. The composition according to claim 1, wherein the alkyl ethoxy sulfate or mixture of alkyl sulfate and alkyl ethoxy sulfate has an average degree of ethoxylation of less than about 5 and more than 0.5 and an average level of branching of from about 5% to about 60%.

6. The composition according to claim 5, wherein the alkyl ethoxy sulfate or mixture of alkyl sulfate and alkyl ethoxy sulfate has an average degree of ethoxylation of less than about 2 and an average level of branching of from about 20% to about 40%.

7. The composition according to claim 1, wherein the amine oxide surfactant is a linear C12-C14 alkyl dimethyl amine oxide.

8. The composition according to claim 1 wherein the weight ratio of the anionic surfactant to amine oxide surfactant is about from 4:1 to about 2:1.

9. The composition according to claim 1 further comprising from about 0.05% to about 2% by weight of the total composition of an amphiphilic alkoxylated polyalkyleneimine and mixtures thereof, wherein the amphiphilic alkoxylated polyalkyleneimine is an alkoxylated polyethyleneimine polymer comprising a polyethyleneimine backbone having average molecular weight range from about 100 to about 5,000 Daltons and the alkoxylated polyethyleneimine polymer further comprising:

i) one or two alkoxylation modifications per nitrogen atom by a polyalkoxylene chain having an average of about 1 to about 50 alkoxy moieties per modification, wherein the terminal alkoxy moiety of the alkoxylation modification is capped with hydrogen, a C1-C4 alkyl or mixtures thereof;

ii) an addition of one C1-C4 alkyl moiety and one or two alkoxylation modifications per nitrogen atom by a polyalkoxylene chain having an average of about 1 to about 50 alkoxy moieties per modification wherein the terminal alkoxy moiety is capped with hydrogen, a C1-C4 alkyl or mixtures thereof; or iii) a combination thereof; and wherein the alkoxy moieties comprise ethoxy (EO) and/or propxy (PO) and/or butoxy (BO) and wherein when the alkoxylation modification comprises EO it also comprises PO or BO.

10. The composition according to claim 1 further comprising a cyclic polyamine of Formula (I):

(I)

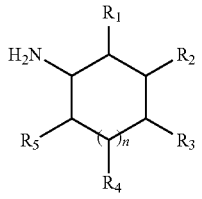

wherein $R_1$, $R_2$, $R_3$, $R_4$ and $R_5$ are independently selected from the group consisting of NH2, —H, linear or branched alkyl having from 1 to 10 carbon atoms, and linear or branched alkenyl having from 1 to 10 carbon atoms, n is 1, and wherein at least one of the Rs is NH2 and the remaining Rs are independently selected from the group consisting of NH2, —H, linear or branched alkyl having 1 to 10 carbon atoms, and linear or branched alkenyl having from 1 to 10 carbon atoms.

11. The composition according to claim 1 further comprising at least one active selected from the group consisting of:

i) from about 0.05% to about 2%, by weight of the total composition of a salt;

ii) from about 1% to about 10% by weight of the total composition of a hydrotrope;

iii) from about 0.01% to about 25% by weight of the total composition of an organic solvent; and iv) mixtures thereof.

12. A method of manually washing dishware comprising the steps of:

i) delivering a composition according to claim 1 onto soiled dishware or a cleaning implement;

ii) cleaning the dishware with the composition in the presence of water; and iii) optionally, rinsing the dishware.

* * * * *